166-308 SR
2/5/80 XR 4,186,802

United States Patent [19]
Perlman

[11] 4,186,802
[45] Feb. 5, 1980

[54] FRACING PROCESS

[76] Inventor: William Perlman, 2302 Niels Esperson Bldg., Houston, Tex. 77002

[21] Appl. No.: 885,944

[22] Filed: Mar. 13, 1978

[51] Int. Cl.[2] ..... E21B 43/26
[52] U.S. Cl. ..... 166/280; 166/308
[58] Field of Search ..... 166/280, 308, 283, 281, 166/271, 259

[56] References Cited

U.S. PATENT DOCUMENTS

| | | | |
|---|---|---|---|
| 3,151,678 | 10/1964 | Hanson et al. | 166/280 |
| 3,396,107 | 8/1968 | Hill | 166/308 X |
| 3,634,237 | 1/1972 | Crenshaw et al. | 166/308 X |
| 3,664,422 | 5/1972 | Bullen | 166/308 X |
| 3,850,247 | 11/1974 | Tinsley | 166/280 |
| 3,888,312 | 6/1975 | Tiner et al. | 166/308 |
| 3,896,877 | 7/1975 | Vogt, Jr. | 166/280 X |
| 3,933,205 | 1/1976 | Kiel | 166/308 |
| 4,078,609 | 3/1978 | Pavlich | 166/308 X |

*Primary Examiner*—Stephen J. Novosad
*Attorney, Agent, or Firm*—Pravel, Gambrell, Hewitt, Kirk, Kimball & Dodge

[57] ABSTRACT

A method for hydraulically fracturing a single subterranean formation in which a fracture is first induced in the formation and then subjected to multiple hydraulic fracturing cycles to generate vertical linear fractures or to linearly extend the fracture outward from the point of introduction of the fracing fluid into a well penetrating the formation. By utilizing fracing fluid containing a high ratio of fine proppant and injected at a low rate, the linear fracturing solely within the formation can be substantially increased with very little or no radial vertical fracturing occurring outside the formation.

23 Claims, 4 Drawing Figures

FRACING PROCESS

BACKGROUND OF THE INVENTION

1. Field of the Invention

This invention relates to hydraulic fracturing of earth formations, and more particularly to the hydraulic fracturing of hydrocarbon bearing formations, i.e., oil and gas sands, for the purpose of increasing the producing rate and total amount of recovery of the hydrocarbons from a well completed in such a formation.

2. Brief Description of the Prior Art

Hydraulic fracturing techniques for hydrocarbon formations are well known and have been extensively used for increasing the recovery of oil and gas from hydrocarbon bearing formations. These techniques involve injecting a fracing fluid down the well bore and into contact with the formation to be fractured. Sufficiently high pressure is applied to the fracing fluid to initiate and propagate a fracture into the formation. Propping materials are generally entrained in the fracing fluid and deposited in the fracture to maintain the fracture open during production.

The function of fracturing is to overcome the deficiency in permeability of the formation adjacent the well bore by creating a highly conductive path reaching out into the producing formation sand and/or rock surrounding the well bore. According to the usual practice, a fluid, such as water, oil, oil/water emulsion, gelled water or gelled oil is pumped down a well bore with sufficient pressure to open a fracture in the formation. The fracing fluid may carry a suitable propping agent, such as sand, glass beads, etc., for the purpose of holding the fracture open after the fracturing fluid has been recovered, e.g., allowing the well to flow. In the case of tight or low permeability wells, that is, wells below one millidarcy permeability, prior art methods of fracturing have produced results that are of but a temporary nature as far as increasing the rate of flow is concerned. After perhaps a short period of accelerated flow, rates of production may drop off to near previous levels. Repeated stimulation with the same or similar procedure may again produce but a temporary gain.

One of the reasons for such a lack of results in a low permeability formation is that at the depths encountered most formations have a preferred vertical fracture orientation which exists because of naturally occurring planes of weakness in the formation as the fracture is formed and are propagated along these planes of weakness. It has been found that these vertical fractures are most advantageous in formations having a relatively wide pay zone and a permeability on the order of 10 to 20 millidarcys.

Unfortunately, many geological oil and gas bearing formations, including some West Texas formations, which are primarily gas formations, comprise multiple, vertically-spaced narrow pay zones, that is 10-to-30 foot pay zone formations, each separated generally by a shale layer. Further, the pay zones are formed in sandstone and have a very low permeability, on the order of 10 to 0.1 millidarcy or less. To further complicate recovery, the pay zones contain contaminants, such as water sensitive clays and iron, which react unfavorably with acids often used in treating the formation.

Using a conventional fracing process, vertical fracturing occurs as above-described. In a gas well of the above-described multiple pay zone type, this results in radial vertical fracturing that extends between the pay zones and through the intervening shale zones. As a result, fracing fluid is lost into the shale zones with no resulting benefit in fracturing the hydrocarbon pay zones.

Additionally, only small vertically oriented radial fractures are created in the pay zones and because of the deep vertical orientation do not permit much radial penetration horizontally into the pay zone itself. A temporary increase in production produced by the vertical fractures is believed to be the result of the fracture permitting communication between the well bore in a small portion of a joint system between the matrix elements of the formation and with a small portion of the reservoir matrix. However, as soon as this low volume space has been drained, productivity drops off to that controlled by the low permeability reservoir matrix, and since the formation area exposed to such matrix by the short radial vertical fractures is small, productivity is low.

The present invention overcomes the disadvantages of the prior art by providing a method for fracturing a producing formation to produce long vertical linear fractures extending outward from a borehole within the zone of interest, with a minimization of radial vertically oriented fractures occurring above and below the producing zone of interest.

SUMMARY OF THE INVENTION

The invention is directed to a method for forming long vertical linear fractures which extend outward from the borehole in a producing zone with a minimization of radial vertical fracturing penetrating into the intervening shale layers. The process comprises multiple fracing stages carrying a fine proppant sand of between 60 to 140 mesh size (average 100 mesh) in a high sand-to-fluid ratio mix, i.e., 4 lbs./gal. or higher. Each carrier stage is immediately followed by a corresponding spacer stage comprising the fracing fluid without a proppant added. Immediately following the final carrier stage and corresponding spacer stage, a terminating stage carrying a medium proppant sand of a 20 to 40 mesh size is injected, followed by a fracing fluid flush of the tubing string. Additionally, the fracing fluid may be made up of up to 70% alcohol by volume in order to reduce the water volume of the fracing fluid which may adversely react with water sensitive clays within the formation. Further, up to 20% liquified $CO_2$ (carbon dioxide) by volume may be combined with the frac water/alcohol mixture to further reduce the water volume for the above-mentioned reason and, in addition, reduce the "wet" liquid injected into the formation.

As above mentioned, most formations have a preferred vertical fracture orientation along naturally occurring planes of weakness. Therefore, it is usually anticipated that vertical fracturing will occur in the formation. However, although a "fracture" will have a generally "vertical" orientation, the plane angle of the propagating fracture may vary greatly in the formation as the planes of formation weakness vary. A fracture may begin as a substantially vertical fracture and end as a substantially horizontal fracture, or begin as a horizontal (pancake) fracture and dip or twist to a more vertical orientation as a further radial distance from the borehole. Accordingly, in the disclosure that follows, the term "vertical" when referring to vertical fracturing, will include all other possible orientations of the fracture in addition to the preferred vertical orientation.

It is a feature of the present invention to provide a method of creating long vertical linear fractures within relatively thin hydrocarbon formations while substantially eliminating radial vertical fractures into the overlying and underlying shale or other non-producing formations.

It is another feature of the present invention to provide a fracing fluid containing a minimum water content which will adversely react with water sensitive clays entrapped in the producing formations.

It is still another feature of the present invention to provide a method of creating vertical linear fractures within a thin producing formation that are much wider than those produced by prior art methods, therefore exposing a much larger vertical area of the formation.

It is yet another feature of the present invention to provide a method of inserting several times the amount of solids into the formation for use as "propping agents" as heretofore has been injected using conventional fracing techniques.

These and other features and advantages of the present invention will become apparent from the following detailed description when considered in conjunction with the accompanying drawings.

BRIEF DESCRIPTION OF THE DRAWINGS

In order that the manner in which the above-recited advantages and features of the invention are attained can be understood in detail, and a more particular description of the invention may be had by reference to the specific embodiment thereof when compared to an embodiment depicting the prior art, both of which are illustrated in the appended drawings, which drawings form a part of this specification. It is to be noted, however, that the appended drawings illustrate only the typical embodiment of the invention and therefore is not to be considered limiting of its scope when the invention may admit to further equally effective embodiments.

In the drawings.

DETAILED DESCRIPTION OF THE PREFERRED EMBODIMENT

Figure 1:
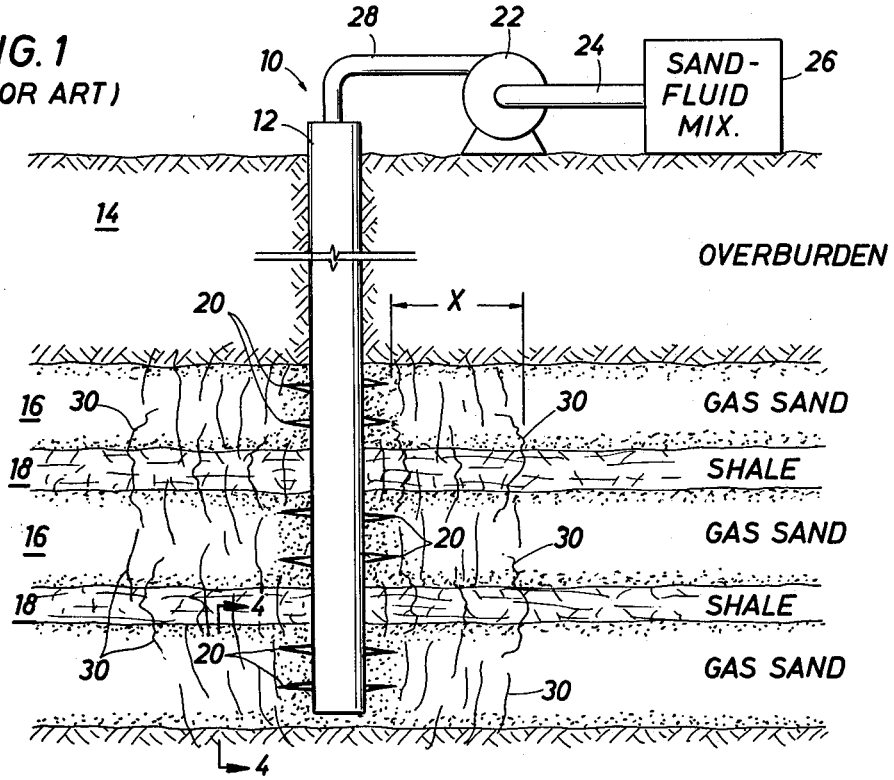
FIG. 1 (PRIOR ART)
FIG. 1 is a cross-sectional view illustrating a borehole penetrating an oil or gas bearing formation for introducing a fracing fluid into contact with the formation, and in particular shows the radial vertical fracturing orientation of multiple pay zones and intervening non-producing formations occurring from conventional fracing techniques.

The time for a pressure disturbance, that is, a pressure drop intiated by a producing well, to be propagated radially from the well bore through a low permeability earth formation, it may take the 20-year period to drain the 14.6-acre area reached by pressure wave front. Further extension will show that it will take the pressure wave 21.5 years to reach the perimeter of a 320-acre square centered on the well bore, and that the volume extending horizontally over such an area would be drainable in 430 years. The pressure wave would take 34 years in the case of a 640-acre tract (one square mile) which would be drainable in 680 years.

It will be apparent from the foregoing that in order to produce a low permeability field within a 20-year period, the well spacing would have to be approximately 900 feet. However, many states have statutes governing well densities in oil and gas fields. It can be seen that it would be impractical to economically produce a well in such a low permeability formation without special producing techniques.

To speed up recovery from low permeability fields, techniques have been developed in the prior art directed to producing radial fractures in the formation which act as drainage channels to permit the production fluid to drain to the well. Generally, a high volume of fracing fluid, on the order of 5,000 or more gallons per stage, is pumped into the formation at a high input rate, in the range of 25 to 50 barrels per minute.

Additionally, various propping agents have been utilized to maintain the fractures created in an open position after the fracturing pressure has been released. For purposes of definition within this application, reference to a "medium" size proppant shall mean a proppant having a mesh size falling within the range of 20 to 40. Further, reference to a "fine" size proppant shall mean a proppant having a mesh size falling within the range of 60 to 140. The above-mentioned definitions are not to be construed as limitations on the invention, as other proppant sizes may be equally effective in realizing the objectives of the invention. Among such propping agents used in the prior art is "medium" sand (20 to 40 mesh), used in preference to "fine" sand (60 to 140 mesh) in the belief that the fine sand would pack too tightly and actually cause the fracture-proppant volume to have a permeability lower than the formation. Generally, a low ratio of proppants to fracing fluid (such as ½ to 2 lbs. of sand per gallon of fluid) was utilized.

When used with a single, relatively thick, medium permeability pay zone, conventional fracing techniques developed in the prior art have proved adequate. However, when the conventional fracing techniques are used to fracture low permeability, relatively thin formations, such as found in several gas-sand areas in West Texas, the resulting production has been much less than expected, as will be hereinafter explained.

Referring now to FIG. 1, conventional hydraulic fracturing techniques utilize a well 10, having casing 12 extending through an overburden 14 into multiple gas-sand pay zones 16, with the pay zones 16 being separated by non-oil or gas bearing strata, such as shale layers 18. A number of perforations 20 are conventionally formed in casing 12 extending into the pay zones 16. Further, a pump 22 connected by tubing 24 to a source of a sand and fracing fluid mixture 26 pumps the fracing fluid mix into the casing 12 through tubing 28 where, as pressure builds up within casing 12, the fluid is forced out through perforations 20 into the producing formations creating fractures 30. Due to the high input rate, the pressure builds up rapidly extending the radial vertical fractures 30 in pay zones 16 through intervening non-producing formations 18. As a result, a large quantity of the fracing fluid and sand is deposited in fractures in zones and strata where there is no oil or gas. Additionally, the vertical extending formation of fractures 30 into upper and lower formations tends to limit the radial length of the vertical fractures to an average length "X". As a result, the short radial vertical fractures within the producing formation expose only a limited area of the formation 16, resulting in production for only a relatively short time and further production must depend on the slow natural drainage through the low permeability of the formation into the fracture and then to the well bore.

Figure 2:
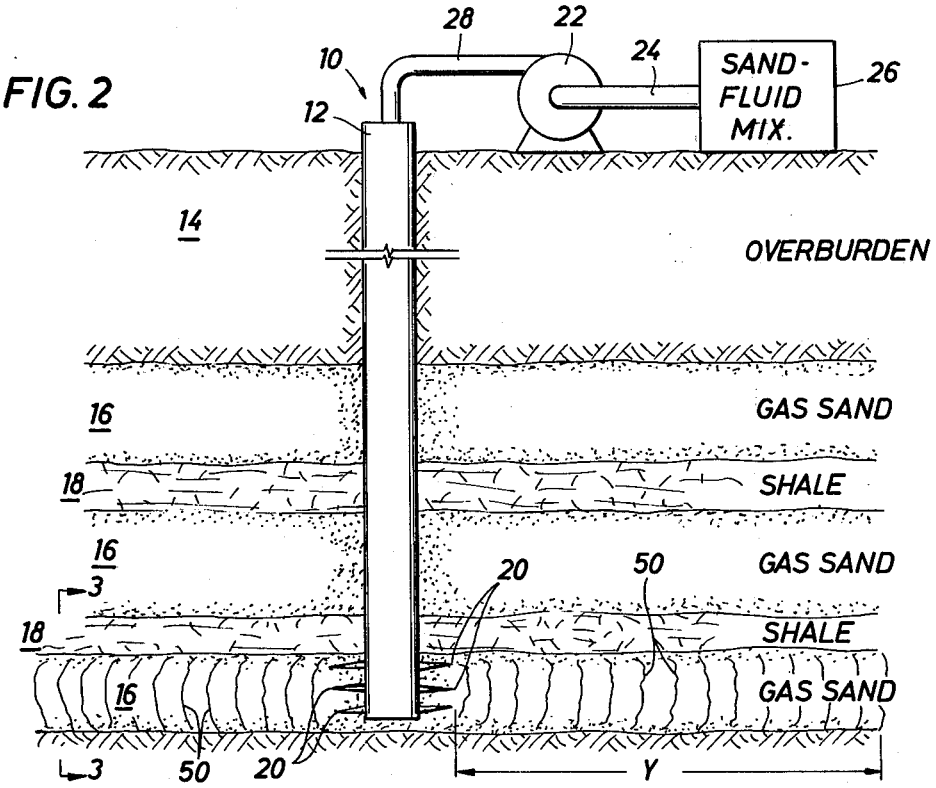
FIG. 2 is a cross-sectional view of a borehole extending into a multiple pay zone hydrocarbon bearing formation and illustrates the long vertical linear fractures created through use of the present invention.

According to the present invention, long vertical linear fractures extending outward from the well casing into a desired producing formation with substantially no vertically oriented fractures extending into overlying or underlying non-producing formations are obtained as will be hereinafter described. Referring now to FIG. 2, the same reference numbers used for FIG. 1 have been used to identify similar components for simplicity. Accordingly, well 10 is shown to include casing 12 extending through overburden 14 into multiple gas-sand pay zones 16, which are separated by intervening shale layers 18. Pump 22 is shown connected to a source of sand and fracing fluid mixture 26 by tubing 24 and pumps the proppant-laden fracing fluid into the tubing (not shown) within casing 12 through piping 28. Conventional techniques are utilized to perforate the casing 12 adjacent a single pay zone 16 as shown by perforations 20.

Thereafter, the perforated section of the casing is isolated in order that as the fracing fluid is injected, it only affects the single pay zone. A relatively low volume of fracing fluid (2,000 to 5,000 gallons per stage) with a high ratio of solids (in this case, sand), such as 4 to 10 lbs. (or greater) of sand per gallon of fracing fluid is injected into the single pay zone 16. A low input rate (such as 9 to 15 barrels per minute) is used which results in the ability to use a 2 to 3-inch tubing for the fracing fluid injection, as opposed to a much larger casing which must be utilized in the conventional fracing method because of the high input rates. Further, the pressure required to fracture the formation is confined to the tubing and the casing adjacent the formation, reducing the surface area on which the pressure must be maintained.

As will be hereinafter described, multiple stages of proppant-laden fracing fluid alternated with corresponding unladen fracing fluid stages are injected causing vertically oriented fractures 50 to extend linearly outward for a length defined by "Y" with little or no radial vertical fracturing occurring outside of the treated pay zone 16. The increased surface area of formation 16 exposed to the longer fracture 50 substantially increases production. Further, by confining fracturing to a single formation, an increased efficiency of production is obtained from that pay zone, without drawing from other zones simultaneously. Once a lowermost formation 16 has been depleted, then the casing 12 would be plugged to seal off the already produced formation and a higher formation would be treated and produced as hereinabove described.

Figure 3:
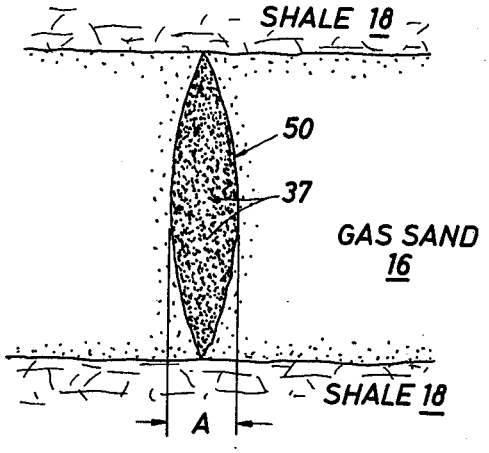
FIG. 3 is a vertical cross-sectional view of a typical vertical linear fracture in the pay zone shown in FIG. 2 as taken along lines 3—3 of FIG. 2.
Figure 4:
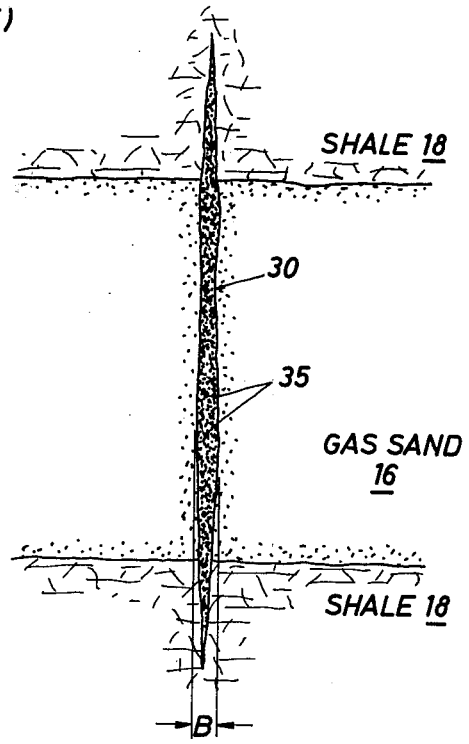
FIG. 4 (PRIOR ART)
FIG. 4 is a vertical cross-sectional view of a typical radial vertical fracture produced by prior art methods as taken along lines 4—4 of FIG. 1.

As previously described, prior art fracing processes utilized in such thin multiple pay zones 16 only obtained fractures 30 having a radial length "X" and a "propped" width "B" (see FIG. 4) of 0.10 inches or less, often in the range of 0.0625 inches utilizing a "medium" proppant 35. Utilizing the process of the present invention, a fracture 50 having a length "Y" (as compared to "X") can be obtained, with a "propped" width "A" (see FIG. 3) of approximately 0.25 inches utilizing a "fine" proppant 37. As hereinabove described, the longer the linear fracture 50 can be made, the greater the producing formation 16 vertical cross-sectional area will be exposed to the fracture 50 to form a low pressure channel to the casing 12, thereby increasing productivity from the pay zone. As can be seen from FIGS. 1 and 2, a certain cross-sectional area of formation 16 is exposed to fractures 30 and 50. Fracture 50 can often be at least 2–5 times the length of fracture 30, thereby increasing the total vertical cross-sectional area exposed to the fracture by at least 200–500% with corresponding increases in productivity. In one test well in which 1,000,000 pounds of proppant (fine sand) was deposited in the formation fracture utilizing the process of this invention, logs and other test data indicated a probable linear fracture of over 2,000 feet wholly within the gas formation.

The methods of the invention can be carried out by any conventional apparatus used for previously known methods of hydraulic fracturing. Thus, suitable apparatus is shown in both FIG. 1, the prior art, and FIG. 2 of this application. The fracturing fluid can be injected through the well tubing, casing or other available or suitable pipe or conduit, and may be flowed back into a pit or into the fracturing fluid tank. The fluid can be injected through perforations in the casing extending through the cement and directly into the formation, the injection being confined to a selected horizontal thin formation through conventional isolation techniques. Additionally, conventional proppant water mixing equipment and pumping equipment may be utilized in performing the method.

The fracturing fluid preferably used in carrying out the method of the present invention is a 2–3% KCl (potassium chloride) water containing conventional gels to increase its viscosity, and is mixed with liquified carbon dioxide ($CO_2$) in predetermined ratios preselected from the range of 10% to 20% $CO_2$ by volume. The $CO_2$ is maintained at $-10°$ F. until combined with the KCl water in mixer 26 just prior to the fracing fluid being pumped into well 12. During injection the $CO_2$ remains liquified since it is under pressure, and only after the temperature reaches 85° F. at the fracing pressures in the formation does the $CO_2$ change to gaseous form. This change to a gas has two benefits. One benefit is the additional energy (when the $CO_2$ gasifies) which assists in removing frac water from the well bore. A second benefit is the reduction of "wet" fluid injected into the formation which must be recovered.

Since many of the producing formations encountered in the multiple pay zone areas of West Texas include water sensitive clays, it is advantageous to reduce the amount of water injected into the formation. In addition to the conventional reduction of water by the above-mentioned addition of $CO_2$, water used in the fracing fluid may be further reduced by the addition of a suitable alcohol in predetermined ratios of up to 70% alcohol by volume of the total fracing fluid. A suitable alcohol for purposes of this application is defined as any alcohol which will reduce the surface tension of the remaining water to enhance pumping of the fracing fluid and, equally important, is miscible with water. By way of example, 57,000 gallons of the preferred fracing fluid could be made up utilizing 13,680 gallons of sand, 11,400 gallons of liquified $CO_2$, 8,880 gallons of $H^2O$ and 23,040 gallons of methanol or isopropyl or other suitable alcohol. Further, the use of fracing fluid combined with alcohol and $CO_2$ within the ratios above-described has led to the recovery of injected fluids in ranges of 80 to 95%.

The injection time depends on the volume of fracing fluid to be injected, which is determined by how large a fracture is desired and is calculated in advance, and upon the flow rate, which depends on the pressure and flow resistance. Further, the total injection time will be the sum of the injection times for the various multiple stages.

The following is an example of an experimental well stimulation treatment carried out according to the invention in a West Texas gas field:

EXAMPLE

| | |
|---|---|
| Formation Thickness | 28' |
| Depth: | 7082' to 7110' |
| Materials: | 3% KCL water plus 20% by volume $CO^2$ and including a base fluid gel having a density of 40#/gal. gelling agent |
| Propping Agent: | Sand, average 100 mesh, 488,600 lbs. and 20/40 mesh 51,000 lbs. |
| Casing: | 4½" O.D. |
| Tubing: | 2⅞" O.D. |
| Perforations: | 22 |
| Pressure | |
| Average on casing | 1500 lbs. |
| Average on tubing | 5500 lbs. |
| Hydraulic Horsepower Used: | 2022 |
| Average Rates in barrels per minute | 15 |
| Number of stages | 40 |
| Volumes: | |
| Pre PAD | 10,000 gal. |
| PAD | 7,000 gal. |
| Proppant Laden Fluid | 66,000 gal. |
| Displacement | 1,000 ga. |
| Total Fluid | 84,000 |

| Event No. | Rate (bpm) | Volume (Incremental Volume) | Pressure (Tubing) | (psi) (Casing) | Description of Operation & Materials |
|---|---|---|---|---|---|
| 1 | | | | | Test Line |
| 2 | 0–15 | 7000 | 0–5000 | 1500 | Pump Pad |
| 3 | 15 | 3000 | 5200 | 1500 | Start sand 4 ppg |
| 4 | 15 | 500 | 5400 | 1500 | Pump Spacer |
| 5 | 16 | 3000 | 5100 | 1500 | Start Sand at 6 ppg |
| 6 | 10 | 500 | 5400 | 1500 | Pump Spacer |
| 7 | 16 | 3000 | 5200 | 1500 | Start sand at 8 g |
| 8 | 15 | 500 | 5200 | 1500 | Pump Spacer |
| 9 | 15 | 3000 | 5200 | 1500 | Start sand at 8 ppg |
| 10 | 15 | 1000 | 5300 | 1500 | Pump Spacer |
| 11 | 15 | 3000 | 5200 | 1500 | Start sand at 10 ppg |
| 12 | 15 | 500 | 5400 | 1500 | Pump Spacer |
| 13 | 15 | 3000 | 5200 | 1500 | Start sand at 10 ppg |
| 14 | 15 | 500 | 5200 | 1500 | Pump Spacer |
| 15 | 15 | 3000 | 5300 | 1500 | Start sand at 10 ppg |
| 16 | 15 | 500 | 5300 | 1500 | Pump Spacer |
| 17 | 15 | 3000 | 5500 | 1500 | Start sand at 10 ppg |
| 18 | 15 | 500 | 5500 | 1500 | Pump Spacer |
| 19 | 13 | 3000 | 5500 | 1500 | Start sand at 10 ppg |
| 20 | 13 | 500 | 6400 | 1500 | Pump Spacer |
| 21 | 13 | 3000 | 5400 | 1500 | Start sand at 10 ppg |
| 22 | 13 | 500 | 6400 | 1500 | Pump Spacer |
| 23 | 13–15 | 3000 | 6400 | 1500 | Start sand at 10 ppg |
| 24 | 15 | 500 | 5100 | 1500 | Pump Spacer |
| 25 | 15 | 3000 | 5600 | 1500 | Start sand at 10 ppg |
| 26 | 15 | 500 | 5400 | 1500 | Pump Spacer |
| 27 | 15 | 3000 | 5100 | 1500 | Start sand at 10 ppg |
| 28 | 15 | 500 | 5200 | 1500 | Pump Spacer |
| 29 | 15 | 3000 | 5400 | 1500 | Start sand at 10 ppg |
| 30 | 14 | 500 | 5700 | 1500 | Pump Spacer |
| 31 | 14 | 3000 | 5700 | 1500 | Start sand at 10 ppg |
| 32 | 14 | 500 | 6400 | 1500 | Pump Spacer |
| 33 | 13 | 500 | 6300 | 1500 | Start sand at 10 ppg |
| 34 | 14 | 500 | 6100 | 1500 | Pump Spacer |
| 35 | 14 | 3000 | 5700 | 1500 | Start sand at 10 ppg |
| 36 | 14 | 500 | 5500 | 1500 | Pump Spacer |
| 37 | 14 | 3000 | 5500 | 1500 | Start sand at 10 ppg |
| 38 | 15 | 1000 | 5500 | 1500 | Spacer |
| 39 | | 12000 | 5500 | 1500 | 20–40 sand at 3 ppg |

The 488,600 lbs. of average 100 mesh sand was injected at a ratio of 10 lbs./gal., while the larger 20–40 mesh sand was injected at 3 lbs./gal.

In a typical fracing treatment, it has been found desirable to average at least an 8-lb./gal. solids ratio of the "fine" proppant (defined above as 60–140 mesh) to fracing fluids. A solids ratio of 12 lbs./gal. has been achieved, but with more advanced blending equipment, solids ratios of 15–20 lbs./gal. should be possible. Of course, a proppant of any suitable size can be utilized if the objectives of the invention are achieved. The final proppant applications were made utilizing a "medium" mesh sand (20–40 mesh), however, other sizes of final proppant could be utilized.

The preferred injection rate is in the range of 10–15 barrels per minute, however, a range of 2–15 barrels per minute has been utilized to obtain satisfactory results and rates of 25 barrels per minute or below may produce preferred results depending on the geology of the pay zone. In field tests, the volume of proppant injected into the producing formation has varied from 200,000 lbs. to 1,000,000 lbs. of proppant in a single pay zone, utilizing fracing fluid volumes of approximatly 50,000 gallons to 200,000 gallons, respectively, for overall average solids ratios of 7 to 8 lbs./gal. In practicing the invention successfully, it has been found that a ratio of at least 25,000 lbs. of proppant per one (1) foot of net pay zone is desirable and can be achieved.

Although specific embodiments have been described in detail hereinbefore, it is understood that the subject invention is not limited thereto, and all variations and modifications thereof are contemplated and included within the spirit and scope of the invention as defined by the appended claims.

What is claimed is:

1. A method of forming vertical linear fractures in a subterranean producing formation extending outwardly from a well penetrating the formation without forming any substantial radial vertical fracturing of overlying or underlying strata, comprising the steps of introducing, in a multiplicity of stages a proppant laden fracing fluid carrying a fine-sized proppant material in an average proppant-to-fluid ratio of at least eight pounds per gallon, introducing between said stages of proppant laden fracing fluid a spacer stage of fracing fluid without proppant, said proppant laden fracing fluid and said spacer fracing fluid being injected at an injection rate below 25 barrels per minute and at a pressure selected for producing said vertical linear fracture in the formation, said introduction of said proppant laden fracing fluid continuing until at least 25,000 pounds of said fine proppant material have been deposited in the formation fracture for each one-foot of available net producing formation.

2. The method described in claim 1, wherein a terminal stage of said fracing fluid carrying a medium-sized proppant material in a proppant-to-fluid ratio less than said fine-sized proppant material proppant-to-fluid ratio is introduced into said fractures for depositing said medium-sized proppant material in the formation adjacent the well bore.

3. The method described in claim 1, wherein said fine-sized proppant material is 60–140 mesh sand.

4. The method described in claim 2, wherein said medium-sized proppant material is 20–90 mesh sand.

5. The method described in claim 1, wherein said fracing fluid is a combination of KCl water, gel and alcohol, and the volume of alcohol combined with said KCl water to form the total volume of said fracing fluid is preselected from the range of 25% to 70% alcohol by volume.

6. The method described in claim 1, wherein said fracing fluid injection rate is selected from within the range of 2 to 20 barrels per minute.

7. The method described in claim 1, wherein said fine-sized proppant material proppant-to-fluid ratio is selected from the range of 8 to 20 pounds of proppant per gallon of fracing fluid.

8. The method disclosed in claim 1, wherein said fracing fluid is a combination of KCl water, gel, alcohol and liquified $CO_2$.

9. The method disclosed in claim 8, wherein the volume of alcohol combined with said KCl water to form the total volume of said fracing fluid is preselected from the range of 25% to 70% alcohol by volume, and the volume of $CO_2$ combined with said KCl water to form said total volume of fracing fluid is preselected from the range of 10% to 20% liquified $CO_2$ by volume.

10. The method disclosed in claim 9, wherein said carrier stage injection rate is selected from within the range of 2 to 20 barrels per minute.

11. The method disclosed in claim 9, wherein said fine-sized proppant material proppant-to-fluid ratio is selected from the range of 8 to 20 pounds of proppant per gallon of fracing fluid.

12. A method of forming vertical linear fractures in a subterranean producing formation extending outwardly from a well penetrating the formation without forming any substantial radial vertical fracturing of overlying or underlying strata, comprising the steps of introducing a plurality of carrier stages of fracing fluid carrying a fine-sized proppant material in an average proppant-to-fluid ratio of at least eight pounds per gallon, said carrier stage fracing fluid being injected at an injection rate below 25 barrels per minute and at a pressure selected for producing the fractures in the formation, introducing a plurality of spacer stages of said fracing fluid, alternating with said carrier stages, at a selected pressure and rate sufficient to carry said carrier stage proppant material into said fracture and away from said well, and introducing a terminal stage of said fracing fluid carrying a medium-sized proppant material in a proppant-to-fluid ratio less than said carrier stage ratio, said terminal stage being injected at a selected pressure and rate sufficient to carry said terminal stage sand into said fractures adjacent said injection well bore.

13. The method described in claim 12, wherein said fine-sized proppant material is 60–140 mesh sand.

14. The method described in claim 13, wherein said medium-sized proppant material is 20–40 mesh sand.

15. The method described in claim 12, wherein said fracing fluid is a combination of KCl water, gel and alcohol, and the volume of alcohol combined with said KCl water to form the total volume of said fracing fluid is preselected from the range of 25% to 70% alcohol by volume.

16. The method described in claim 12, wherein said carrier stage injection rate is selected from the range of 2 to 20 barrels per minute.

17. The method described in claim 12, wherein said carrier stage proppant-to-fluid ratio is selected from the range of 8 to 20 pounds of proppant per gallon of fracing fluid.

18. The method disclosed in claim 12, wherein introduction of said carrier stages is continued to achieve a proppant volume of at least 25,000 pounds of said fine-sized proppant material deposited into the formation fracture for each one-foot of vertical net pay zone of the formation.

19. The method disclosed in claim 12, wherein said fracing fluid is a combination of KCl water, gel, alcohol and liquified $CO_2$.

20. The method disclosed in claim 19, wherein the volume of alcohol combined with said KCl water to form the total volume of said fracing fluid is preselected from the range of 25% to 70% alcohol by volume, and the volume of $CO_2$ combined with said KCl water to form said total volume of fracing fluid is preselected from the range of 10% to 20% liquified $CO_2$ by volume.

21. The method disclosed in claim 20, wherein said carrier stage injection rate is selected from the range of 2 to 20 barrels per minute.

22. The method disclosed in claim 20, wherein said carrier stage proppant-to-fluid ratio is selected from the range of 8 to 20 pounds of proppant per gallon of fracing fluid.

23. The method disclosed in claim 22, wherein introduction of said carrier stages is continued to achieve a proppant volume of 25,000 pounds of said fine-sized proppant material deposited into the formation fracture for each one-foot of vertical net pay zone of the formation.

* * * * *